US010708693B2

(12) United States Patent
Shibuya et al.

(10) Patent No.: US 10,708,693 B2
(45) Date of Patent: Jul. 7, 2020

(54) OSCILLATORY COMPONENT FOR LOUDSPEAKERS, LOUDSPEAKER COMPRISING SAME, AND MOBILE DEVICE EQUIPPED WITH SAID LOUDSPEAKER

(71) Applicant: Panasonic Intellectual Property Management Co., Ltd., Osaka (JP)

(72) Inventors: Tomonori Shibuya, Osaka (JP); Yoshiyuki Takahashi, Okayama (JP); Nobuo Nakamura, Mie (JP); Takayuki Dan, Osaka (JP); Tetsushi Itano, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 7 days.

(21) Appl. No.: 16/302,286

(22) PCT Filed: Jun. 15, 2017

(86) PCT No.: PCT/JP2017/022044
§ 371 (c)(1),
(2) Date: Nov. 16, 2018

(87) PCT Pub. No.: WO2018/008347
PCT Pub. Date: Jan. 11, 2018

(65) Prior Publication Data

US 2019/0297423 A1 Sep. 26, 2019

(30) Foreign Application Priority Data

Jul. 4, 2016 (JP) ..... 2016-132127

(51) Int. Cl.
*H04R 7/12* (2006.01)
*H04R 7/18* (2006.01)
(Continued)

(52) U.S. Cl.
CPC ..... *H04R 7/125* (2013.01); *H04R 7/10* (2013.01); *H04R 7/18* (2013.01); *H04R 9/025* (2013.01);
(Continued)

(58) Field of Classification Search
CPC . H04R 7/125; H04R 7/10; H04R 7/18; H04R 9/025; H04R 9/06; H04R 31/003;
(Continued)

(56) References Cited

U.S. PATENT DOCUMENTS 3,508,626 A 4/1970 Robbins
2010/0059309 A1* 3/2010 Kajihara ..... H04R 31/003 181/169
2016/0134972 A1 5/2016 Shibuya et al.

FOREIGN PATENT DOCUMENTS

JP 54-086321 A 7/1979
JP 3-254598 11/1991

OTHER PUBLICATIONS

The Extended European Search Report dated Apr. 3, 2019 for the related European Patent Application No. 17823954.7.
(Continued)

*Primary Examiner* — Sean H Nguyen
(74) *Attorney, Agent, or Firm* — Greenblum & Bernstein, P.L.C.

(57) ABSTRACT

A vibration component for loudspeakers includes a base layer, an intermediate layer, and a coating layer. The base layer has a front face and a rear face, has a first density, and is formed of a paper body containing a plurality of fibers. The intermediate layer has a first face joined to the front face of the base layer, and a second face on a reverse side of the intermediate layer from the first face, has a second density higher than the first density, and includes a plurality of cellulose fibers as a main component. The coating layer is
(Continued)

provided on the second face of the intermediate layer, and includes an inorganic powder formed of a plurality of inorganic fine particles.

19 Claims, 9 Drawing Sheets

(51) Int. Cl.

| | |
|---|---|
| ***H04R 9/02*** | (2006.01) |
| ***H04R 9/06*** | (2006.01) |
| ***H04R 31/00*** | (2006.01) |
| ***H04R 7/10*** | (2006.01) |
| ***H04R 9/04*** | (2006.01) |
| ***H04R 1/02*** | (2006.01) |

(52) U.S. Cl.
CPC ..... *H04R 9/06* (2013.01); *H04R 31/003* (2013.01); *H04R 1/02* (2013.01); *H04R 9/046* (2013.01); *H04R 2307/021* (2013.01); *H04R 2307/023* (2013.01); *H04R 2307/027* (2013.01); *H04R 2307/029* (2013.01); *H04R 2400/11* (2013.01)

(58) Field of Classification Search
CPC .... H04R 1/02; H04R 9/046; H04R 2307/021; H04R 2307/023; H04R 2307/027; H04R 2307/029; H04R 2400/11
USPC ..... 381/398
See application file for complete search history.

(56) References Cited

OTHER PUBLICATIONS

International Search Report of PCT application No. PCT/JP2017/022044 dated Aug. 8, 2017.

* cited by examiner

OSCILLATORY COMPONENT FOR LOUDSPEAKERS, LOUDSPEAKER COMPRISING SAME, AND MOBILE DEVICE EQUIPPED WITH SAID LOUDSPEAKER

CROSS-REFERENCE TO RELATED APPLICATIONS

This application is a U.S. national stage application of the PCT International Application No. PCT/JP2017/022044 filed on Jun. 15, 2017, which claims the benefit of foreign priority of Japanese patent application No. 2016-132127 filed on Jul. 4, 2016, the contents all of which are incorporated herein by reference.

TECHNICAL FIELD

The present disclosure relates to a vibration component including a paper layer and a coating layer made of an inorganic material, a loudspeaker including the vibration component, and a movable-body apparatus equipped with the loudspeaker.

BACKGROUND ART

Conventional diaphragms include a paper layer and a coating layer. The paper layer is formed of cellulose fibers. The coating layer contains an inorganic material and a resin. The coating layer is laminated on the paper layer.

The paper layer of the conventional diaphragms is produced using a dispersion liquid obtained by dispersing cellulose fibers in water. First, the dispersion liquid is dewatered by papermaking to produce a cellulose fiber deposit. Next, the deposit is dried to form a paper layer for a diaphragm. Subsequently, onto the thus-formed paper layer, a mixed solution of an inorganic material and a resin is applied as a coating layer. Finally, the resultant is heated to cure the resin. Through the above-described steps, a diaphragm including a paper layer and a coating layer laminated on the paper layer can be manufactured (for example, see Patent Literature 1).

CITATION LIST

Patent Literature 1: Japanese Patent Unexamined Publication No. H3-254598

SUMMARY OF INVENTION

The present disclosure provides a vibration component in which, although coating is applied to a base layer including a high energy loss material, a coating layer is formed with a uniform thickness, whereby favorable acoustic characteristics are maintained.

The vibration component for loudspeakers according to the present disclosure includes a base layer, an intermediate layer, and a coating layer. The base layer has a front face and a rear face; has a first density; and is formed of a paper body containing a plurality of fibers. The intermediate layer has a first face joined to the front face of the base layer, and a second face on a reverse side of the intermediate layer from the first face; has a second density higher than the first density; and includes a plurality of cellulose fibers as a main component. The coating layer is provided on the second face of the intermediate layer, and includes an inorganic powder containing a plurality of inorganic fine particles.

Since the intermediate layer having a higher density than the base layer is laminated on the base layer, the coating layer has a uniform thickness when the vibration component is coated, and thus the vibration component can have improved acoustic characteristics.

In a loudspeaker according to the present disclosure, the above-described vibration component is applied to at least one of a diaphragm and a voice coil body. Furthermore, a movable-body apparatus according to the present disclosure is equipped with the loudspeaker in which the diaphragm is formed of the above-described vibration component.

DESCRIPTION OF EMBODIMENTS

Prior to the description of an embodiment of the present disclosure, problems with conventional diaphragms will be briefly described. In conventional vibration components made from paper, the paper layer is formed by making cellulose fibers into paper. To achieve flat and favorable frequency characteristics, cellulose fibers with a low beating degree and a high energy loss are used. Furthermore, to enhance the strength of the vibration components, a surface of the paper layer is sometimes coated with a coating material.

However, when the coating material is applied directly to the paper layer including cellulose fibers with a high energy loss, the coating material easily permeates through the paper layer because the density of the paper layer is remarkably lower than the density of the coating material. Accordingly, it is difficult to form a coating layer with a uniform thickness on the paper layer when the coating material is applied to a surface of the paper layer, and as a result, acoustic characteristics deteriorate.

Hereinafter, a loudspeaker including a diaphragm which is an example of a vibration component according to the present embodiment will be described with reference to the drawings.

Figure 1:
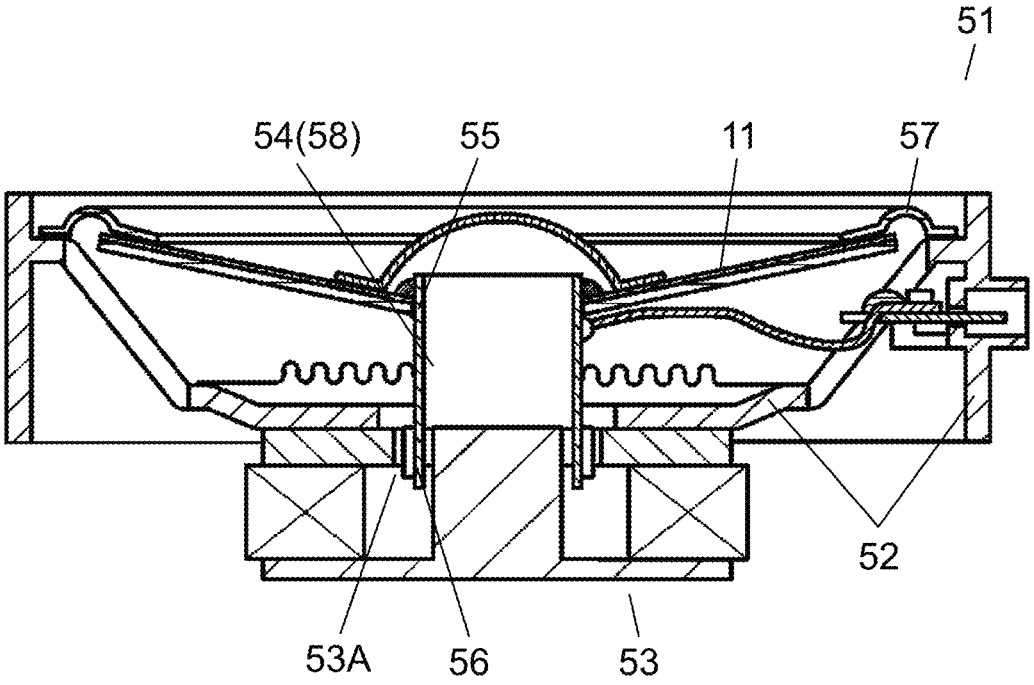
FIG. 1 is a cross-sectional view of a loudspeaker according to an embodiment of the present disclosure.

FIG. 1 is a cross-sectional view of loudspeaker 51. Loudspeaker 51 includes frame 52, magnetic circuit 53 provided with magnetic gap 53A, voice coil body 54, and diaphragm 11. Magnetic circuit 53 is fixed to the rear face of the center portion of the frame 52. An outer peripheral portion of diaphragm 11 and frame 52 are coupled to each other via edge 57. Voice coil body 54 includes bobbin 58 and a coil (not illustrated) wound around bobbin 58. Voice coil body 54 has first end 55 bonded to the center portion (inner peripheral portion) of diaphragm 11, and second end 56 inserted in magnetic gap 53A.

Figure 2A:
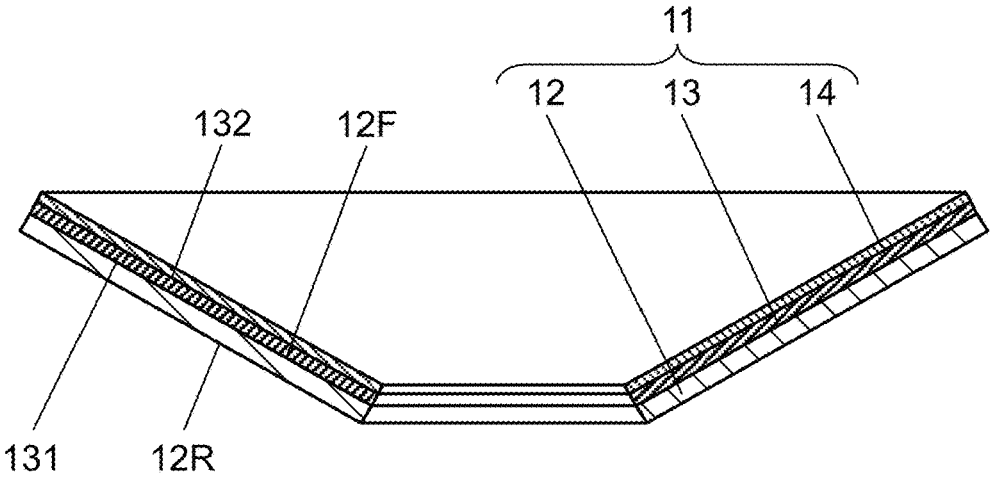
FIG. 2A is a cross-sectional view of a diaphragm of the loudspeaker illustrated in FIG. 1.
Figure 2B:
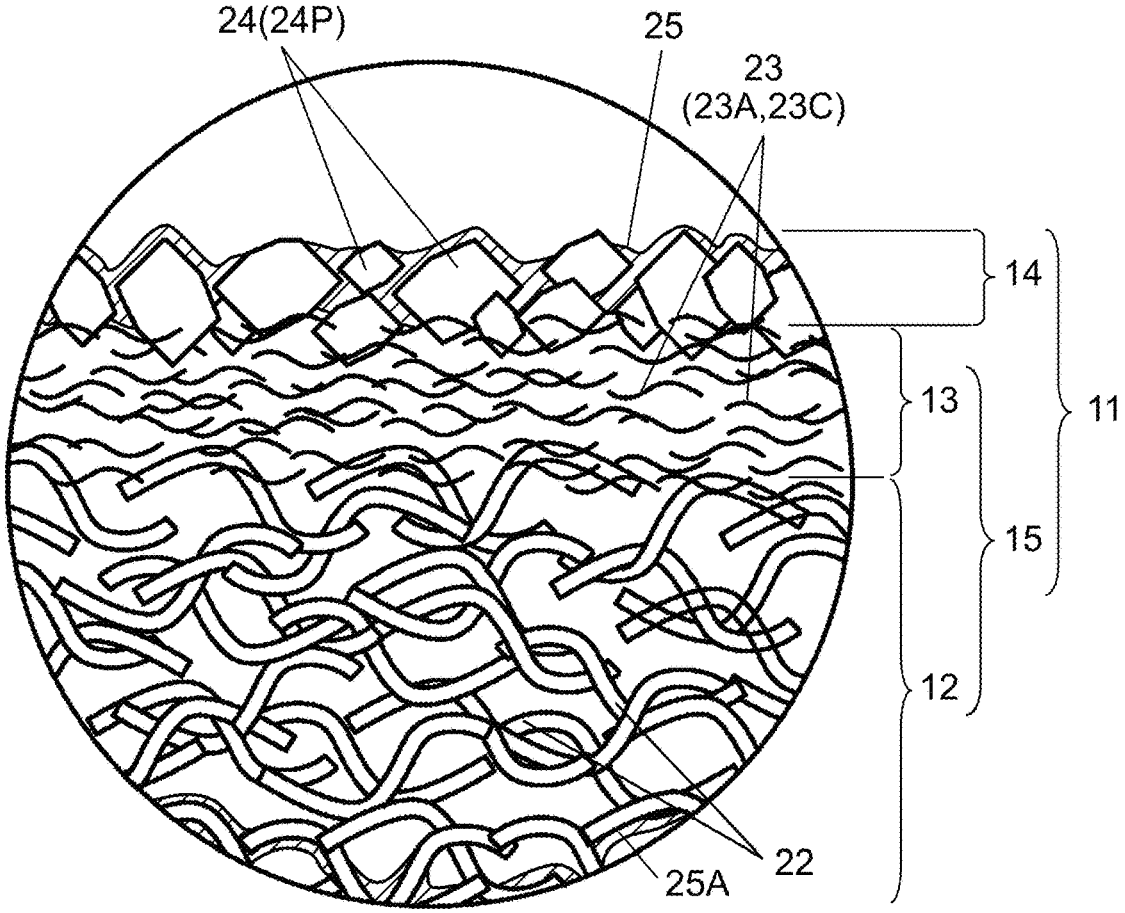
FIG. 2B is a schematic diagram illustrating an enlarged sectional view of the diaphragm illustrated in FIG. 2A.

FIG. 2A is a cross-sectional view of diaphragm 11. FIG. 2B is a schematic diagram illustrating an enlarged sectional view of diaphragm 11. Diaphragm 11 includes base layer 12, intermediate layer 13, and coating layer 14.

As illustrated in FIG. 2B, base layer 12 includes natural fibers 22, and is formed by papermaking. Note that natural fibers 22 are the main components which make up the highest proportion of substances constituting base layer 12. In other words, base layer 12 is formed of a paper body containing a plurality of fibers, and, besides natural fibers 22, base layer 12 may include chemical fibers. Base layer 12 has a first density. Furthermore, base layer has front face 12F, which is a face on the front side of diaphragm 11, and rear face 12R on a reverse side of diaphragm 11 from front face 12F.

Intermediate layer 13 is laminated on a surface of base layer 12. Specifically, intermediate layer 13 has first face 131 joined to front face 12F of base layer 12, and second face 132 on a reverse side of intermediate layer 13 from first face 131. As illustrated in FIG. 2B, intermediate layer 13 includes a plurality of cellulose fibers 23. Cellulose fibers 23 are the main components which make up the highest proportion of substances constituting intermediate layer 13. Intermediate layer 13 has a second density higher than the first density.

Coating layer 14 is formed on a face of the intermediate layer 13 (a face on the front side of diaphragm 11). The face is on the opposite side from base layer 12. In other words, coating layer 14 is formed on second face 132 of intermediate layer 13. As illustrated in FIG. 2B, coating layer 14 includes inorganic powder 24 formed of a plurality of inorganic fine particles 24P.

Intermediate layer 13 including cellulose fibers 23 has a density higher than the density of base layer 12 including natural fibers 22, and cellulose fibers 23 are accumulated in such a manner that cellulose fibers 23 fill gaps between natural fibers 22. This structure can prevent inorganic powder 24 disposed on second face 132 of intermediate layer 13 from widely diffusing in intermediate layer 13 and widely permeating base layer 12. As a result, variations in the thickness of coating layer 14 can be reduced, which results in that diaphragm 11 has a higher rigidity and a higher sound velocity. Furthermore, since coating layer 14 includes inorganic powder 24, diaphragm 11 is excellent in moisture resistance and moisture-proofness. Furthermore, as coating layer 14 includes inorganic powder 24, the grade of appearance is improved because of the metallic luster, and the rigidity is enhanced, which results in favorable sound pressure frequency characteristics.

With the above-described structure, diaphragm 11 has a higher rigidity and a higher sound velocity than those of conventional diaphragms. Accordingly, loudspeaker 51 including diaphragm 11 has a wider reproduction frequency band. Furthermore, loudspeaker 51 has a higher sound pressure level. Note that loudspeaker 51 including diaphragm 11 as an example of the vibration component is described above; however, besides diaphragm 11, the structure of the vibration component according to the present embodiment may be applied to bobbin 58 or a dust cap.

Figure 3:
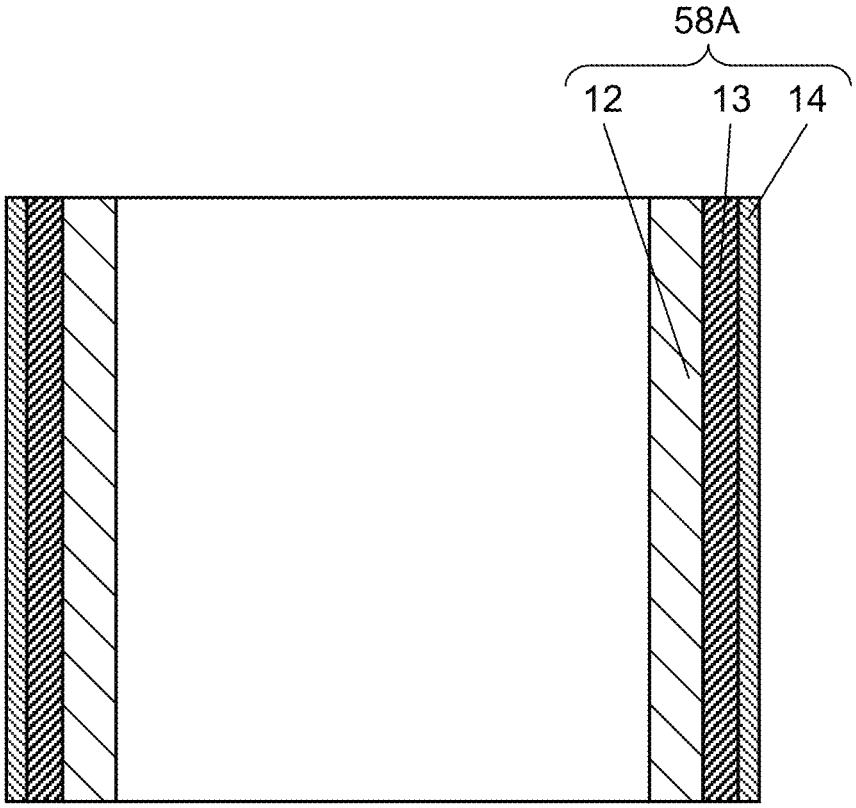
FIG. 3 is a cross-sectional view of a voice coil bobbin of the loudspeaker illustrated in FIG. 1.

FIG. 3 is a cross-sectional view of bobbin 58A, which is a vibration component according to the present embodiment. Bobbin 58A includes base layer 12, intermediate layer 13, and coating layer 14. This three-layer structure is the same as that of the above-described diaphragm 11, and therefore the description thereof will be omitted. The three-layer structure of bobbin 58A can prevent acoustic characteristics from deteriorating due to an influence of humidity and the like. Furthermore, intermediate layer 13 has the effect of making the thickness of coating layer 14 uniform, and accordingly loudspeaker 51 has improved acoustic characteristics. The same as the case of using diaphragm 11 and the case of using bobbin 58A goes for a case in which the dust cap is the vibration component according to the present embodiment. That is, excellent moisture resistance and excellent waterproofness are provided, and loudspeaker 51 has improved acoustic characteristics and a higher grade of appearance because of the metallic luster.

Hereinafter, diaphragm 11 as a typical example of the vibration component will be described in detail with reference to FIG. 2B. Each of natural fibers 22 included in base layer 12 has a comparatively longer fiber length, and gaps between natural fibers 22 are large. Since a material with a high energy loss is thus used in base layer 12, flat and favorable frequency characteristics can be achieved.

Note that the vibration component is not limited to diaphragm 11 or bobbin 58A, and is only required to be a vibration-related component. That is, examples of the vibration component include a coupling cone, a dust cap, a sub-cone, and other accessories added to diaphragm 11.

Intermediate layer 13 includes cellulose fibers 23. For example, the fiber length of cellulose fibers 23 is shorter than the fiber length of natural fibers 22. In other words, the average fiber length of cellulose fibers 23 is shorter than the average fiber length of the fibers constituting base layer 12. With this structure, gaps in intermediate layer 13 are smaller than those in base layer 12. Hence, the density of intermediate layer 13 is higher than the density of base layer 12.

Alternatively, the diameter of cellulose fibers 23 may be smaller than the diameter of natural fibers 22. In other words, the average diameter of cellulose fibers 23 is smaller than the average diameter of the fibers constituting base layer 12. With this structure, gaps in intermediate layer 13 are smaller than those in base layer 12. Hence, the density of intermediate layer 13 is higher than the density of base layer 12.

With at least one of the above-described structures, cellulose fibers 23 enter gaps between natural fibers 22, thereby filling the gaps. Thus, the fibers entangled with each other cause stronger bonding between base layer 12 and intermediate layer 13, and furthermore, roughness in a surface (front face 12F) of base layer 12 is reduced by intermediate layer 13. Thus, coating layer 14 can be laminated flat and uniformly on the front face of intermediate layer 13. As a result, the grade of appearance can be improved while favorable acoustic characteristics are maintained. Furthermore, when the coating material is applied so as to partially embed at least some of inorganic fine particles 24P in intermediate layer 13, stronger bonding between intermediate layer 13 and coating layer 14 is achieved. As a result, coating layer 14 is less likely to be peeled off from intermediate layer 13, which results in an improvement in quality reliability.

As described above, the diameter of each of cellulose fiber 23 is preferably smaller than the diameter of each of natural fibers 22. This structure allows intermediate layer 13 to have a density higher than the density of base layer 12. Therefore, the main components which make up the highest proportion of substances constituting cellulose fibers 23 are preferably cellulose nanofibers 23A. Cellulose nanofibers 23A are cellulose-containing fibers each having a nano-level diameter.

Intermediate layer 13 including cellulose nanofibers 23A is lightweight and has a high rigidity. Accordingly, diaphragm 11 having intermediate layer 13 including cellulose nanofibers 23A as the main components has rigidity. Thus, without a reduction in sound pressure frequency characteristics, the surface of diaphragm 11 can be made flat.

Figure 4A:
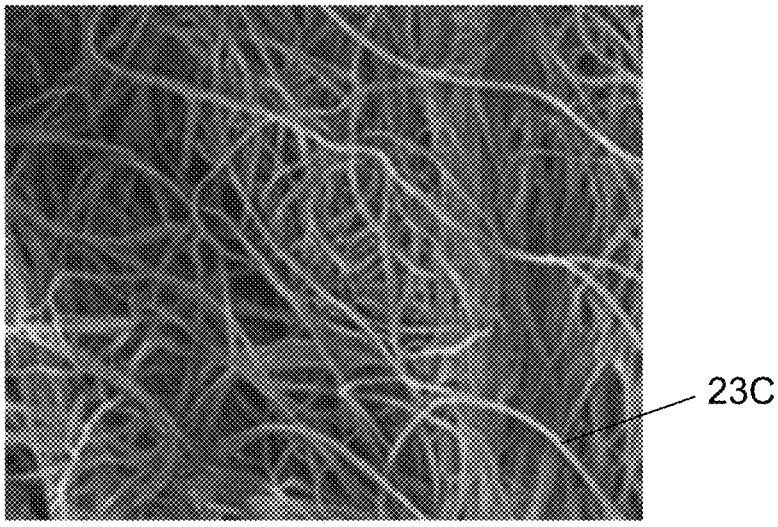
FIG. 4A is a scanning electron microscope (SEM) image of nanofibers constituting an example of an intermediate layer of a vibration component according to the embodiment of the present disclosure.

FIG. 4A is a scanning electron microscope (SEM) image of bamboo nanofibers 23C, which is an example of cellulose nanofiber 23A. Cellulose nanofibers 23A are preferably bamboo nanofibers 23C. Bamboo nanofibers 23C are nanofibers made of bamboo. Bamboo nanofibers 23C are bamboo fibers each micronized to have a nano-level size.

Bamboo nanofibers 23C have an elastic modulus higher than the elastic modulus of natural fibers 22, that is, the elastic modulus of base layer 12. Furthermore, bamboo nanofibers 23C have an internal loss smaller than the internal loss of natural fibers 22, that is, the internal loss of base layer 12. Hence, the elastic modulus of intermediate layer 13 is higher than the elastic modulus of base layer 12. Furthermore, the internal loss of intermediate layer 13 is smaller than the internal loss of base layer 12.

As described above, each of bamboo nanofibers 23C has a high rigidity. Therefore, as bamboo nanofibers 23C are used for intermediate layer 13, intermediate layer 13 can have a smaller thickness while keeping the rigidity. As a result, intermediate layer 13 can prevent a reduction in the internal loss of diaphragm 11. Since a reduction in the internal loss of diaphragm 11 is prevented, loudspeaker 51 exhibits favorable sound pressure frequency characteristics. Hence, diaphragm 11 including bamboo nanofibers 23C has a higher elasticity and a larger internal loss.

Bamboos, serving as a raw material of bamboo nanofibers 23C, inhabit globally, and grow very quickly. Therefore, bamboo fibers are easily available. Furthermore, a process of micronizing bamboo fibers to have a nano-level size can be realized by diverting most of existing processes of forming bamboo fiber into a microfibril. This diversion saves the necessity of introducing a new facility. Furthermore, unlike bacterial cellulose, bamboo nanofibers 23C do not require cultivation of bacteria or the like. Hence, bamboo nanofibers 23C provide extremely higher productivity than bacterial cellulose. As a result, bamboo nanofibers 23C are extremely inexpensive, compared to bacterial cellulose.

In this case, the internal loss of bamboo nanofibers 23C is preferably 70% or more of the internal loss of natural fibers 22. With this structure, a reduction in the internal loss of laminated body 15 can be prevented even if the internal loss of bamboo nanofibers 23C is smaller than the internal loss of natural fibers 22.

The fiber diameter of each of bamboo nanofibers 23C is preferably in a range from approximately 4 nm to approximately 200 nm, inclusive. The above-mentioned fiber diameter is observed by SEM. The fiber diameter of each of bamboo nanofibers 23C is more preferably in a range from approximately 4 nm to approximately 40 nm, inclusive. With this structure, bamboo nanofibers 23C entangled with each other cause stronger bonding therebetween.

Natural fibers 22, which are the main components of base layer 12, preferably contain cellulose. As natural fibers 22, for example, wood pulp or non-wood pulp may be used. Alternatively, wood pulp and non-wood pulp may be used in combination.

When both base layer 12 and intermediate layer 13 contain cellulose as described above, base layer 12 and coating layer 13 are firmly stuck to each other by hydrogen bonding between the celluloses and by the entanglement of the celluloses.

Natural fibers 22 included in base layer 12 preferably have a lower beating degree. In particular, when the beating degree is 25° SR (Schopper Riegler) or lower, base layer 12 can have a larger internal loss, and flat and favorable frequency characteristics can be achieved. Generally, when the beating degree is made higher, enhanced rigidity causes peaks and dips to easily occur in the mid- to high-frequency ranges of sound pressure frequency characteristics, whereby favorable frequency characteristics cannot be achieved.

In contrast, when the beating degree is made lower in order to achieve flat and favorable frequency characteristics, the length of each of the fibers is longer, and accordingly, roughness in a surface of base layer 12 of diaphragm 11 tend to be larger. This is because, when the fibers are longer, the surface of base layer 12 of diaphragm 11 is fluffier.

When the structure according to the present disclosure is applied to diaphragm 11 having such fluffier surface of base layer 12, intermediate layer 13 including the short fibers with the diameter of nano-level enters large depressions in a surface of base layer 12. Accordingly, as described above, the surface is smoothed, and the roughness becomes smaller. Thus, coating layer 14 is formed to be smooth. Furthermore, as for acoustic characteristics, by making the internal loss of base layer 12 larger, flat and favorable frequency characteristics can be achieved. Rigidity reduced due to a larger internal loss of base layer 12 can be offset by providing intermediate layer 13. Thus, loudspeaker 51 can have favorable frequency characteristics while maintaining a desired rigidity.

Figure 4B:
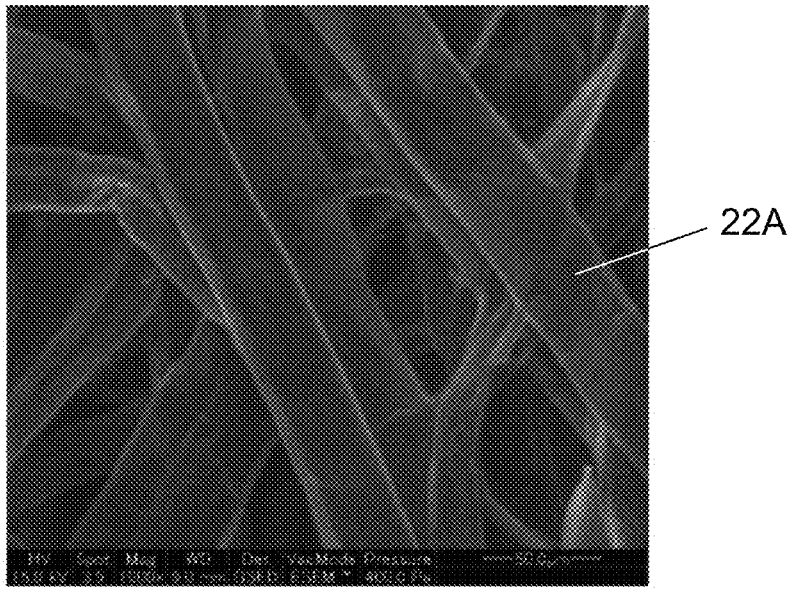
FIG. 4B is a scanning electron microscope (SEM) image of wood pulp constituting an example of a paper layer of the vibration component according to the embodiment of the present disclosure.

FIG. 4B is a scanning electron microscope (SEM) image of wood pulp 22A, which is an example of natural fibers 22. As described above, natural fibers 22 included in base layer 12 preferably contain cellulose. Note that, in the case of using non-wood pulp for base layer 12, bamboo fibers are preferably employed as the non-wood pulp. In this case, intermediate layer 13 is preferably formed of bamboo nanofibers. In this structure, both base layer 12 and intermediate layer 13 are formed of bamboo fibers. With this structure, the bamboo fibers of base layer 12 and the bamboo nanofibers of intermediate layer 13 entangled with each other cause stronger bonding between base layer 12 and intermediate layer 13.

Since bamboos grow fast, depletion of forest resources can be prevented. Accordingly, diaphragm 11 can contribute to reduction in global environmental destruction. Furthermore, the rigidity of bamboo fibers is higher than the rigidity of common wood pulp. Therefore, the use of bamboo fibers for base layer 12 permits the rigidity of diaphragm 11 to be enhanced.

Intermediate layer 13 may be formed on rear face 12R of base layer 12, or may be formed on both front face 12F and rear face 12R. In other words, a location at which intermediate layer 13 is formed is not necessarily on front face 12F of base layer 12. For example, intermediate layer 13 may be formed on rear face 12R of base layer 12. Alternatively, intermediate layers 13 may be formed on both front face 12F and rear face 12R of base layer 12. However, when intermediate layer 13 is disposed on at least front face 12F of base layer 12, the waterproofness of diaphragm 11 is improved.

Figure 5A:
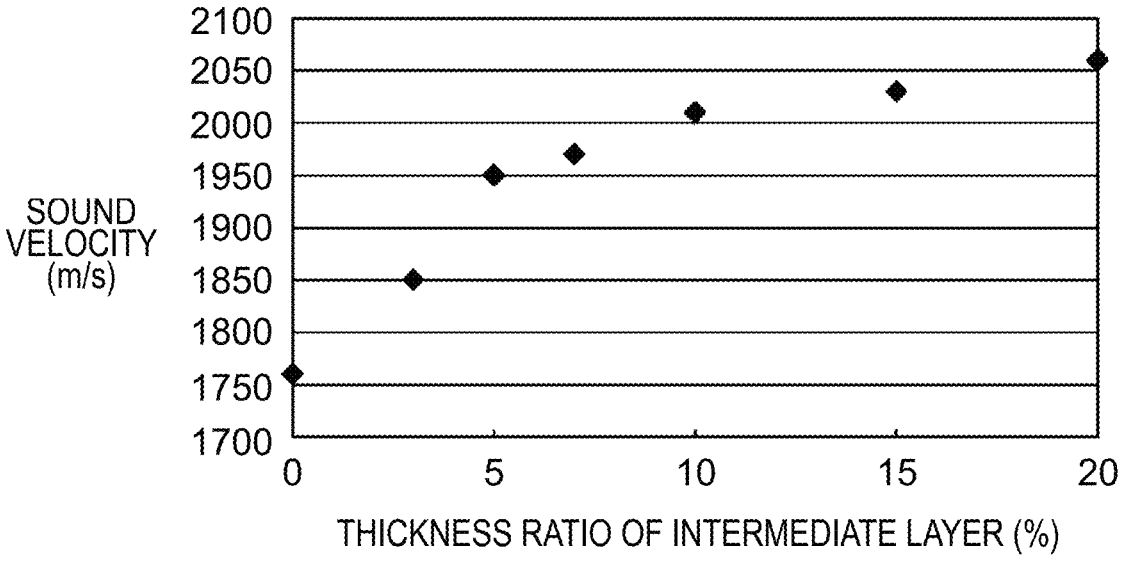
FIG. 5A is a graph showing an example of sound velocity characteristics of the diaphragm according to the embodiment of the present disclosure.
Figure 5B:
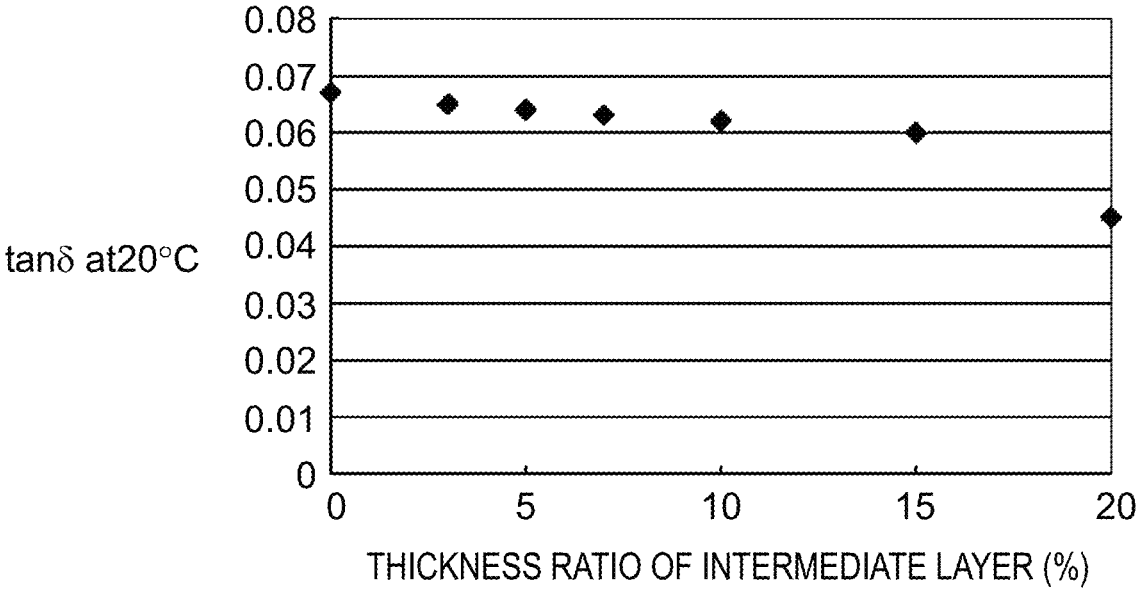
FIG. 5B is a graph showing an example of internal loss characteristics of the diaphragm according to the embodiment of the present disclosure.

Next, an influence of the thickness ratio between base layer 12 and intermediate layer 13 will be described. To evaluate an influence of the thickness of intermediate layer 13 on characteristics of diaphragm 11, laminated body 15 (see FIG. 2B) configured with only base layer 12 and intermediate layer 13 is produced. Then, with changing the thickness of intermediate layer 13, sound velocity characteristics and internal loss characteristics of laminated body 15 are evaluated. FIG. 5A is a graph showing an example of the sound velocity characteristics of laminated body 15. FIG. 5B is a graph showing an example of the internal loss characteristics of laminated body 15. The horizontal axis in each of FIG. 5A and FIG. 5B indicates the ratios of the thickness of intermediate layer 13 with respect to the total thickness of laminated body 15. The vertical axis in FIG. 5A indicates values of sound velocity of laminated body 15. The vertical axis in FIG. 5B indicates values of internal loss of laminated body 15. Note that the total thickness of laminated body 15 and the thickness of intermediate layer 13 are measured by SEM image observation. The total thickness of laminated body 15 is measured by setting the magnification of a SEM at 100 times. In contrast, the thickness of intermediate layer 13 is measured by setting the magnification of a SEM at 300 times.

As shown in FIG. 5A, in the cases where the thickness of intermediate layer 13 reaches 5% or more with respect to the total thickness of laminated body 15, the rate of increase in the sound velocity of laminated body 15 sharply decreases. Then, in the cases where the thickness of intermediate layer 13 reaches 10% or more with respect to the total thickness of laminated body 15, the increase in the sound velocity of laminated body 15 becomes almost saturated and stable.

On the other hand, as shown in FIG. 5B, in the cases where the thickness of intermediate layer 13 is 15% or less with respect to the total thickness of laminated body 15, the reduction in the internal loss of laminated body 15 is small. Hence, intermediate layer 13 whose thickness is 15% or less with respect to the total thickness of laminated body 15 can prevent deformation in laminated body 15. Hence, the thickness of intermediate layer 13 is preferably 5% or more and 15% or less, more preferably 10% or more and 15% or less with respect to the thickness of laminated body 15. This structure permits diaphragm 11 to have a higher elastic modulus and a higher sound velocity, and prevents a reduction in the internal loss of diaphragm 11.

Note that, in the above-described example, the relation between base layer 12 and intermediate layer 13 is defined by the ratio of thickness of intermediate layer 13; however, this is not the only option available. For example, the relation may be defined by the ratio of the weight of intermediate layer 13 with respect to the total weight of laminated body 15. In this case, the weight of intermediate layer 13 is preferably 6% by weight or more and 26% by weight or less with respect to the total weight of laminated body 15. Alternatively, besides the thickness ratio and the weight ratio, intermediate layer 13 may be defined by, for example, specific gravity or area density. The range of any of specific gravity and area density can be calculated from a value of the thickness ratio or the weight ratio.

In the cases where the thickness of intermediate layer 13 is 10% or less with respect to the total thickness of laminated body 15, variations in the internal loss of diaphragm 11 are very small. Hence, the thickness of intermediate layer 13 is more preferably 10% or less with respect to the thickness of laminated body 15. In other words, the thickness of intermediate layer 13 is more preferably 5% or more and 10% or less, most preferably 10% with respect to the total thickness of laminated body 15. This structure permits laminated body 15 to have a higher elastic modulus and a higher sound velocity, and prevents a reduction in the internal loss of laminated body 15.

Next, coating layer 14 will be described in detail. Inorganic powder 24 contains at least one of mica and alumina. The mica may be a natural mineral or an artificial mineral. Mica and alumina are very hard, thereby allowing the rigidity of diaphragm 11 to be enhanced.

Inorganic powder 24 preferably further contains at least one of titanium oxide ($TiO_2$), iron oxide (at least one of $Fe_2O_3$ and $Fe_2O_2$), and zirconia ($ZrO_2$). This allows a desired color tone to be given to diaphragm 11, thereby the grade of appearance is improved.

Inorganic powder 24 may further contain at least one of tin oxide (such as $SnO_2$), silicon dioxide ($SiO_2$), and glass. Inorganic powder 24 including these substances offers a higher gloss, and thus, the grade of appearance is improved. Furthermore, stronger bonding between intermediate layer 13 and coating layer 14 is achieved.

Note that the lamination of titanium oxide or other substances on mica or alumina serving as a base material allows rigidity and the grade of appearance to be improved. Furthermore, tin oxide or other substances may be laminated on the titanium oxide or other substances.

Next, an influence of the thickness of coating layer 14 on diaphragm 11 will be described. To evaluate the influence, evaluation samples of diaphragm 11 which have different ratios of the weight of coating layer 14 with respect to the total weight of diaphragm 11 are produced with changing the thickness of coating layer 14. For the evaluation samples, inorganic powder 24 including mica of 53.5 wt %, $TiO_2$ of 40 wt %, and $Fe_2O_3$ of 6.5 wt % is used. The particle diameter of inorganic fine particles 24P is in a range from 10 μm to 60 μm, inclusive. The total thickness of each evaluation sample of diaphragm 11 is 900 μm. The sound velocity characteristics and the internal loss characteristics of the evaluation samples of diaphragm 11 are evaluated. Coating layer 14 having a thickness of 15% or less with respect to the total thickness of diaphragm 11 can prevent a reduction in the internal loss of diaphragm 11. Furthermore, coating layer 14 having a thickness of 15% or less with respect to the total thickness of diaphragm 11 can prevent a deformation in diaphragm 11.

Figure 6A:
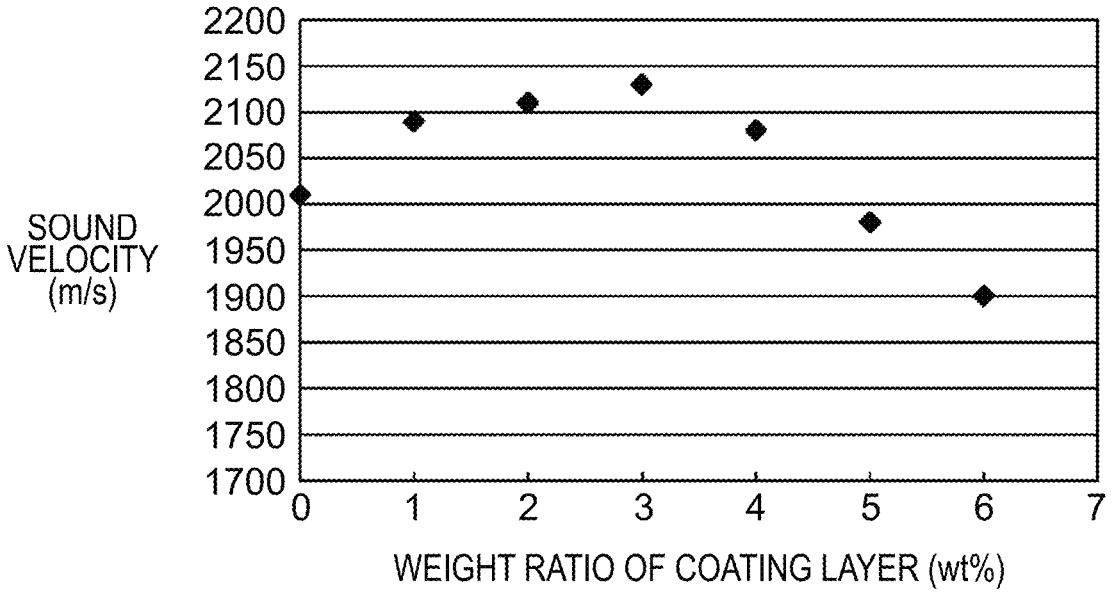
FIG. 6A is a graph showing another example of sound velocity characteristics of the diaphragm according to the embodiment of the present disclosure.
Figure 6B:
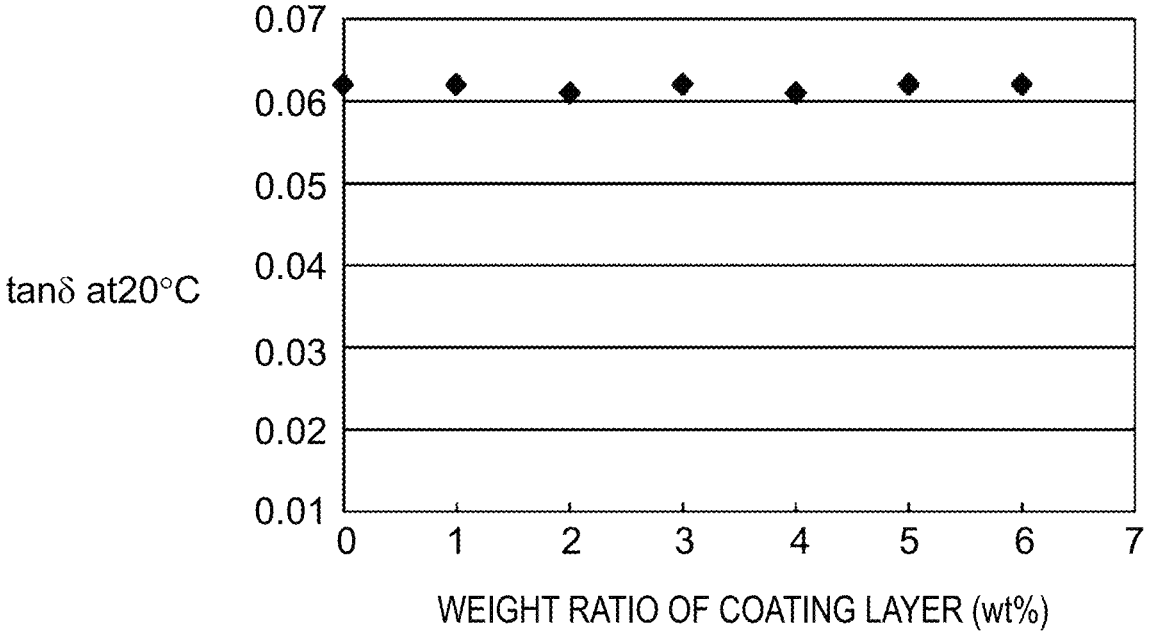
FIG. 6B is a graph showing another example of internal loss characteristics of the diaphragm according to the embodiment of the present disclosure.

FIG. 6A is a graph showing an example of sound velocity characteristics of diaphragm 11. FIG. 6B is a graph showing an example of internal loss characteristics of diaphragm 11. The horizontal axis in each of FIG. 6A and FIG. 6B indicates the ratios of the weight of coating layer 14 with respect to the total weight of diaphragm 11. The vertical axis in FIG.

6A indicates values of sound velocity of diaphragm 11. The vertical axis in FIG. 6B indicates values of internal loss of diaphragm 11.

As shown in FIG. 6A, in particular, in cases where the weight of coating layer 14 is 1 wt % or more and 4 wt % or less with respect to the total weight of diaphragm 11, diaphragm 11 has larger sound velocity values. As shown in FIG. 6B, variations in values of internal loss of diaphragm 11 due to the thickness of coating layer 14 in the above-mentioned weight range are small. Hence, the weight of coating layer 14 is preferably 1 wt % or more and 4 wt % or less with respect to the total weight of diaphragm 11 serving as a vibration component. This structure allows diaphragm 11 to have a still higher elastic modulus and a still higher sound velocity, and prevents a reduction in the internal loss of diaphragm 11.

Note that, in the description above, coating layer 14 is defined by thickness, but this is not the only option available. Coating layer 14 may be defined simply by the ratio of the weight of coating layer 14 with respect to the total weight of diaphragm 11. In this case, the weight of coating layer 14 is preferably 1 wt % or more and 4 wt % or less with respect to the total weight of diaphragm 11. Alternatively, besides the thickness ratio and the weight ratio, coating layer 14 may be defined by, for example, specific gravity or area density. The range of any of specific gravity and area density can be calculated from a value of the thickness ratio or the weight ratio.

Each sample of diaphragm 11 has a thickness of 900 μm. The particle diameter of inorganic fine particles 24P is in a range from 10 μm to 60 μm, inclusive. Here, the coating material is applied so that inorganic powder 24 is partially embedded in intermediate layer 13. With such coating, the strength of bonding between coating layer 14 and intermediate layer 13 is enhanced.

Diaphragm 11 is preferably light in weight. Accordingly, diaphragm 11 is preferably thin. The thickness of common diaphragm 11 is in a range from 200 μm to 600 μm, inclusive. Here, the preferable thickness of diaphragm 11 is in a range from 200 μm to 400 μm, inclusive. To achieve the effects of coating layer 14 while keeping the weight of diaphragm 11 light, the thickness of coating layer 14 may be, for example, 1/100 or more and 1/25 or less of the thickness of diaphragm 11.

For example, the thickness of coating layer 14 is preferably in a range from 2 μm to 8 μm, inclusive, with respect to diaphragm 11 having a thickness of 200 μm. The thickness of coating layer 14 is preferably in a range from 6 μm to 24 μm, inclusive, with respect to diaphragm 11 having a thickness of 600 μm.

To make inorganic fine particles 24P partially stuck in intermediate layer 13, the thickness of coating layer 14 is required to be smaller than the maximum particle diameter of inorganic powder 24. In cases where the maximum particle diameter of inorganic fine particles 24P is 60 μm, inorganic fine particles 24P can be partially embedded in intermediate layer 13 of diaphragm 11 having a thickness of 600 μm. In cases where the minimum particle diameter of inorganic fine particles 24P is 10 μm, inorganic fine particles 24P can be partially embedded in intermediate layer 13 of diaphragm 11 having a thickness of 200 μm.

As illustrated in FIG. 2B, coating layer 14 preferably further includes coating material 25 to embed inorganic fine particles 24P. This can prevent inorganic fine particles 24P from coming off diaphragm 11. To partially embed inorganic fine particles 24P in intermediate layer 13, the maximum thickness of coating material 25 is only required to be smaller than the maximum particle diameter of inorganic fine particles 24P.

As coating layer 14 includes coating material 25, adhesion between coating layer 14 and intermediate layer 13 is enhanced. Accordingly, diaphragm 11 has a higher rigidity. Furthermore, since coating material 25 fills gaps between inorganic fine particles 24P, diaphragm 11 has higher water resistance and higher moisture resistance. Furthermore, the internal loss of coating material 25 is larger than the internal loss of inorganic powder 24. Accordingly, diaphragm 11 can have a larger internal loss.

Coating material 25 preferably includes a thermosetting resin. This structure enhances the heat resistance of diaphragm 11. Furthermore, base layer 12 and intermediate layer 13 may include the resin constituting coating material 25. This structure allows the internal loss of diaphragm 11 to be made still larger. In addition, this structure further improves the water resistance and waterproofness of diaphragm 11.

Coating layer 14 is preferably formed on second face 132 of intermediate layer 13 so that coating layer 14 is located on a reverse side of diaphragm 11 from a side on which magnetic circuit 53 of loudspeaker 51 is disposed when diaphragm 11 is incorporated into loudspeaker 51. This structure makes the front face of diaphragm 11 glossy. Thus, the front face of diaphragm 11 is smooth and very beautiful without sticking a laminate film to the front face of diaphragm 11. As a result, diaphragm 11 is lighter in weight and has a higher sound velocity, compared to a diaphragm to which a laminate film is stuck.

Furthermore, bamboo nanofibers 23C is very highly filled in intermediate layer 13. That is, gaps between bamboo nanofibers 23C in intermediate layer 13 are small. With this structure, intermediate layer 13 prevents water and other substances from permeating through base layer 12. Therefore, it is not necessary to apply waterproof treatment to diaphragm 11. Furthermore, since diaphragm 11 includes coating layer 14 on intermediate layer 13, diaphragm 11 further prevents water and other substances from permeating through base layer 12. Of course, waterproof treatment may be optionally applied to diaphragm 11. The thickness of a waterproof film of diaphragm 11 in this case can be reduced. As a result, diaphragm 11 is lighter in weight and has a higher sound velocity, compared to a diaphragm to which common waterproof treatment is applied.

Next, a method for producing diaphragm 11 will be described. Base layer 12 is formed by papermaking. Base layer 12 is manufactured by depositing a mixture of beaten natural fibers 22 and water on a net. Subsequently, cellulose fibers 23 are applied onto a surface of the deposit of base layer 12 to produce laminated body 15. As cellulose fibers 23, cellulose nanofibers 23A or bamboo nanofibers 23C may be used. Here, cellulose fibers 23 are beforehand mixed with water. Alternatively, cellulose fibers 23 may be applied by dry-spraying onto the surface of the wet deposit of base layer 12. In this state, a precursor of laminated body 15 is configured with a precursor of base layer 12 and a precursor of intermediate layer 13 laminated on the precursor of base layer 12. Subsequently, the precursor of laminated body 15 is dewatered by suction or other manners.

Subsequently, inorganic powder 24 dispersed in water is applied onto a surface of intermediate layer 13 of laminated body 15. Alternatively, inorganic powder 24 may be applied by dry-spraying onto the surface of laminated body 15. Then, the resultant is hot-pressed to form dry diaphragm 11. Through the above-described steps, diaphragm 11 including base layer 12, intermediate layer 13, and coating layer 14 is completed. Note that, when inorganic powder 24 is merely applied to the surface of laminated body 15, inorganic powder 24 is in a state of just attaching to the surface of intermediate layer 13. Hence, when the resultant is merely dried, the strength of bonding between laminated body 15 and inorganic powder 24 is weak. Therefore, after the application of inorganic powder 24, diaphragm 11 is press-formed. At that time, diaphragm 11 is compressed by a press. This compression causes at least some of inorganic fine particles 24P to be partially embedded in intermediate layer 13.

Cellulose fibers 23 are preferably applied onto the wet deposit of base layer 12. This process allows hydrogen bonding between cellulose of cellulose fibers 23 and cellulose of natural fibers 22 to be stronger. Accordingly, diaphragm 11 can have a higher elastic modulus. Note that intermediate layer 13 is formed by coating cellulose fibers 23 onto the deposit not having been dewatered, but, a way of forming intermediate layer 13 is not limited to this. For example, intermediate layer 13 may be formed by coating a dispersion liquid of cellulose fibers 23 onto a dewatered deposit of base layer 12. In this case, since the deposit of base layer 12 has been merely dewatered, the deposit contains moisture. Hence, hydrogen bonding between cellulose of cellulose fibers 23 and cellulose of natural fibers 22 can be stronger also in this case.

Alternatively, base layer 12 may be formed by dewatering only the deposit and then hot-pressing only this dewatered deposit. In this case, cellulose fibers 23 are applied onto base layer 12 that has been subject to drying and forming processes. In this case, base layer 12 is in a dry state, and hence, base layer 12 is unlikely to be broken, which results in high productivity.

In the case where coating layer 14 includes coating material 25, a precursor of hot-pressed diaphragm 11 is impregnated with a resin. At that time, this precursor is immersed in a solution (a resin solution) including, for example, a resin and a solvent such as alcohol to dissolve the resin. Then, the solvent is removed by heating. With this operation, coating layer 14 is structured to include inorganic powder 24 and coating material 25. Note that the resin may be applied onto the precursor of diaphragm 11. In this case, the resin solution is applied to the precursor of diaphragm 11.

Intermediate layer 13 is densely filled with cellulose fibers 23. Accordingly, even when the precursor of diaphragm 11 is immersed in a resin solution, the solution does not permeate through intermediate layer 13, but permeates only second face 132 of intermediate layer 13 or the vicinity of second face 132. Accordingly, coating material 25 is formed in a region from second face 132 of intermediate layer 13 or the vicinity of second face 132 to surfaces of inorganic fine particles 24P. Depending on the concentration of the resin solution, inorganic fine particles 24P could be sometimes partially exposed from coating material 25. On the other hand, the resin solution permeates also from rear face 12R of base layer 12. Accordingly, when the precursor of diaphragm 11 is immersed in the resin solution, out of the fibers constituting base layer 12, at least fibers exposed to rear face 12R are covered with coating material 25A formed of the same material as coating material 25, as illustrated in FIG. 2B. As described above, while gaps between the fibers constituting base layer 12 are maintained, the surfaces of some of the fibers are coated with a resin so that the fibers are bonded together, thereby, while internal loss is maintained, rigidity can be improved.

Next, various modifications of diaphragm 11 will be described. That is, diaphragms described below can be used in place of diaphragm 11 in FIG. 1.

Figure 7A:
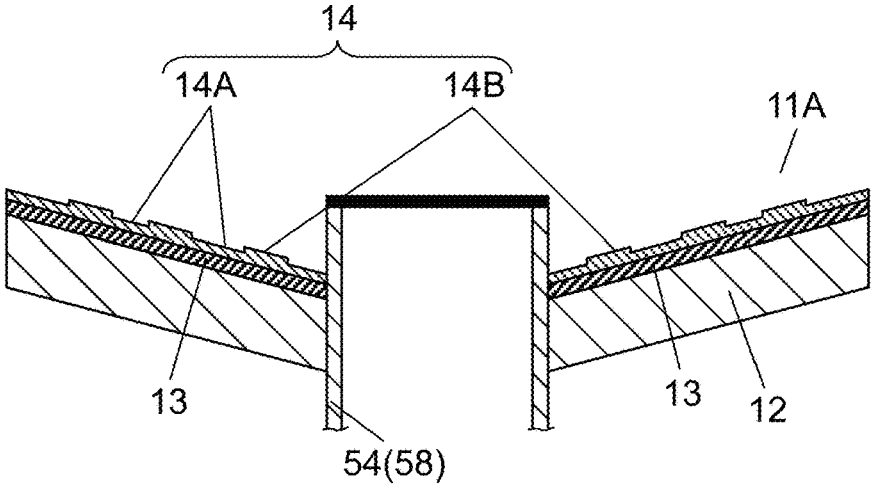
FIG. 7A is a cross-sectional view of another diaphragm according to the embodiment of the present disclosure.

FIG. 7A is a cross-sectional view of diaphragm 11A. Diaphragm 11A includes first coating part 14A and second coating part 14B. Second coating part 14B is thicker than first coating part 14A. Second coating part 14B is formed in a region in which split resonance occurs in diaphragm 11A. With this structure, diaphragm 11A has higher strength in second coating part 14B, thereby the occurrence of split resonance can be suppressed. As a result, diaphragm 11A has fewer peaks and dips in the sound pressure frequency characteristics thereof. Note that diaphragm 11B having a structure illustrated in FIG. 7B may be used. In diaphragm 11B, intermediate layer 13 and coating layer 14 are provided also on rear face 12R of base layer 12 in this order. That is, diaphragm 11B has second coating parts 14B on both faces.

Figure 7B:
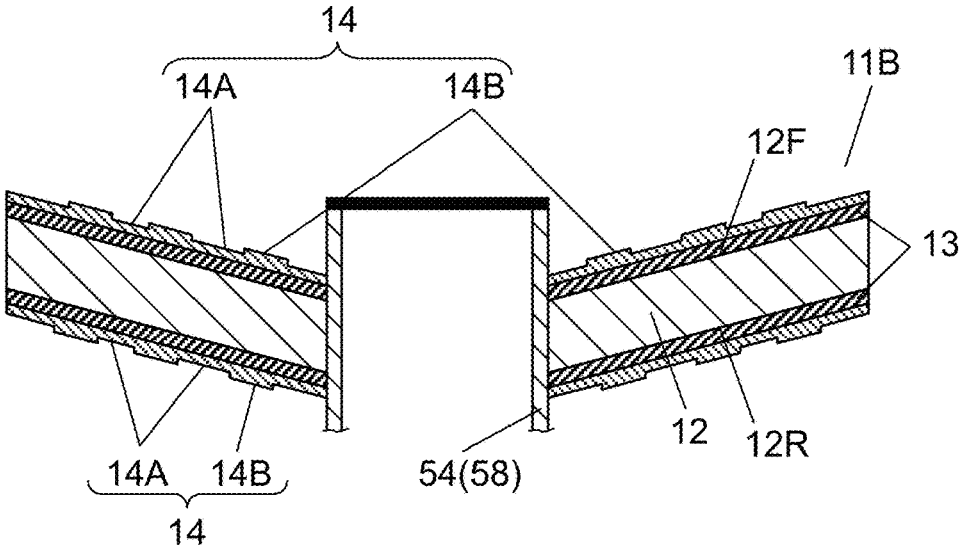
FIG. 7B is a cross-sectional view of still another diaphragm according to the embodiment of the present disclosure.
Figure 7C:
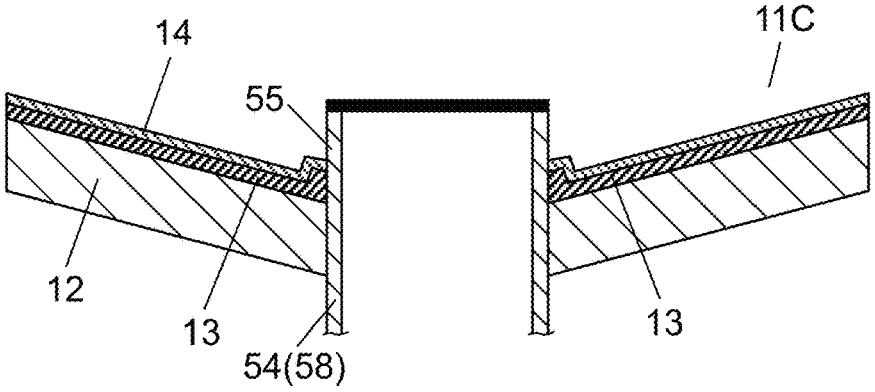
FIG. 7C is a cross-sectional view of still another diaphragm according to the embodiment of the present disclosure.

FIG. 7C is a cross-sectional view of diaphragm 11C, which is still another example. In diaphragm 11C, an inner peripheral portion of intermediate layer 13, the portion being bonded to first end 55 of voice coil body 54, is thicker than other portions of intermediate layer 13. This structure provides higher strength to a portion at which diaphragm 11C and voice coil body 54 are bonded together. Accordingly, vibration from voice coil body 54 is sufficiently propagated to diaphragm 11C. As a result, loudspeaker 51 outputs a higher sound pressure. To make descriptions more understandable, each of diaphragms 11A to 11C in FIG. 7A to FIG. 7C is expressed to be thicker than voice coil body 54. In FIG. 7A to FIG. 7C, part of voice coil body 54 is illustrated.

Figure 7D:
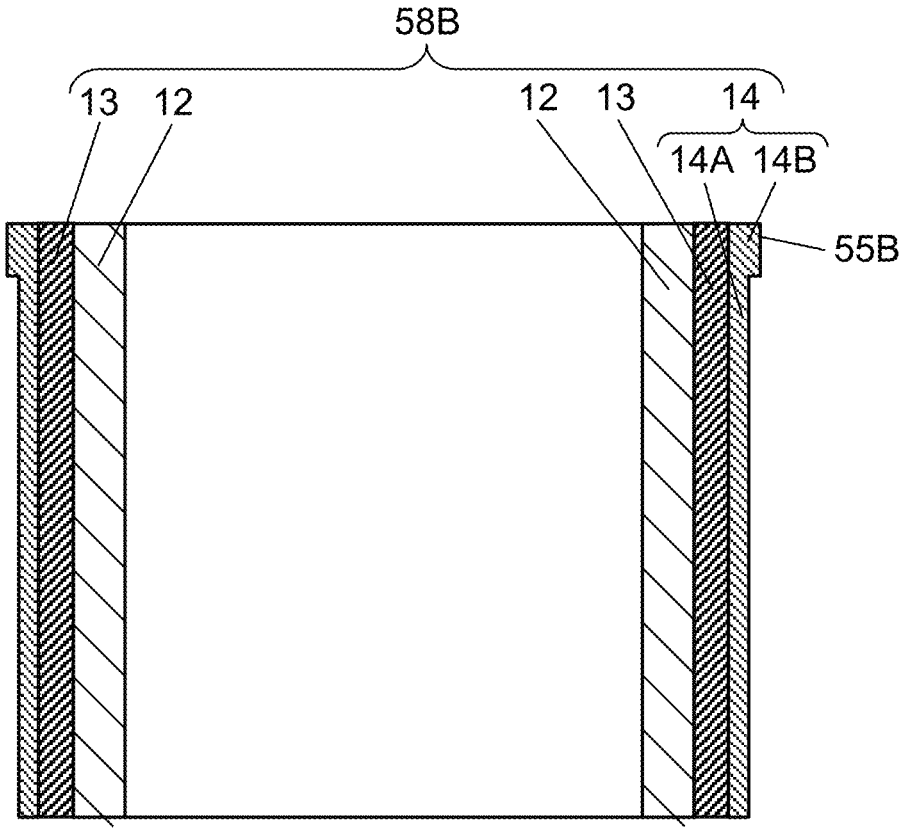
FIG. 7D is a cross-sectional view of another voice coil bobbin according to the embodiment of the present disclosure.

FIG. 7D is a cross-sectional view of bobbin 58B, which is a modification of bobbin 58A. That is, voice coil body 54 illustrated in FIG. 1 may include bobbin 58B in place of bobbin 58A illustrated in FIG. 3. In this case, first end 55B of bobbin 58B is bonded to diaphragm 11 illustrated in FIG. 1. Bobbin 58B includes first coating part 14A and second coating part 14B thicker than first coating part 14A. In this case, second coating part 14B is preferably formed at first end 55B. This structure provides higher strength to a portion at which diaphragm 11 and voice coil body 54 illustrated in FIG. 1 are bonded together. Accordingly, vibration from voice coil body 54 is sufficiently propagated to diaphragm 11. As a result, loudspeaker 51 outputs a higher sound pressure.

Figure 8:
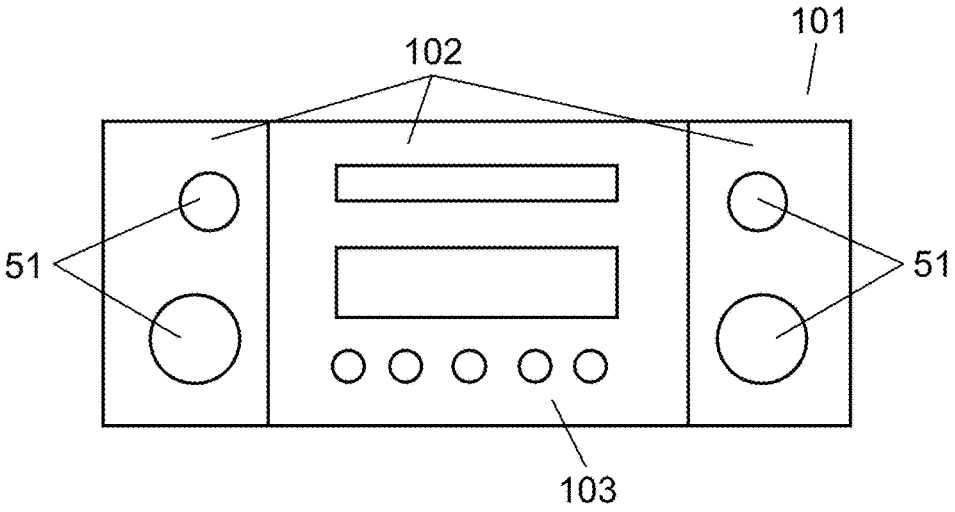
FIG. 8 is a conceptual diagram of an electronic device according to the embodiment of the present disclosure.

FIG. 8 is a conceptual diagram of electronic device 101 according to the present embodiment. Electronic device 101 includes casing 102, signal processor 103, and loudspeakers 51. Examples of electronic device 101 include a component stereo set.

Signal processor 103 is accommodated in casing 102. Signal processor 103 processes sound signals. Signal processor 103 includes an amplifier. Signal processor 103 may further include a sound source. In this case, the sound source may include one or more of, for example, a compact disc (CD) player, an MP3 player, and a radio receiver.

Note that electronic device 101 is not limited to a component stereo set. Electronic device 101 may be, for example, a video device such as a television, a mobile phone, a smartphone, a personal computer, or a tablet terminal. In such cases, electronic device 101 further includes a display (not illustrated). In these cases, signal processor 103 processes not only sound signals, but also video signals.

Loudspeakers 51 are fixed to casing 102. For example, by using an adhesive or a screw, frame 52 illustrated in FIG. 1 is fixed to casing 102. Casing 102 may be divided into a section for housing signal processor 103 and loudspeaker boxes for fixing loudspeakers 51. Alternatively, casing 102 may have an integral structure configured to accommodate signal processor 103 and fix loudspeakers 51.

An output end of signal processor 103 is electrically connected to loudspeakers 51. In this case, the output end of signal processor 103 is electrically connected to a coil of voice coil body 54 illustrated in FIG. 1. Thus, signal processor 103 supplies sound signals to voice coil body 54. In particular, in electronic device 101, coating layer 14 is preferably formed in the front face of diaphragm 11 as illustrated in FIG. 2A. With this structure, even when diaphragm 11 is exposed from casing 102, the beautiful appearance, originated from glossy diaphragm 11, of electronic device 101 can be prevented from being spoiled.

Figure 9:
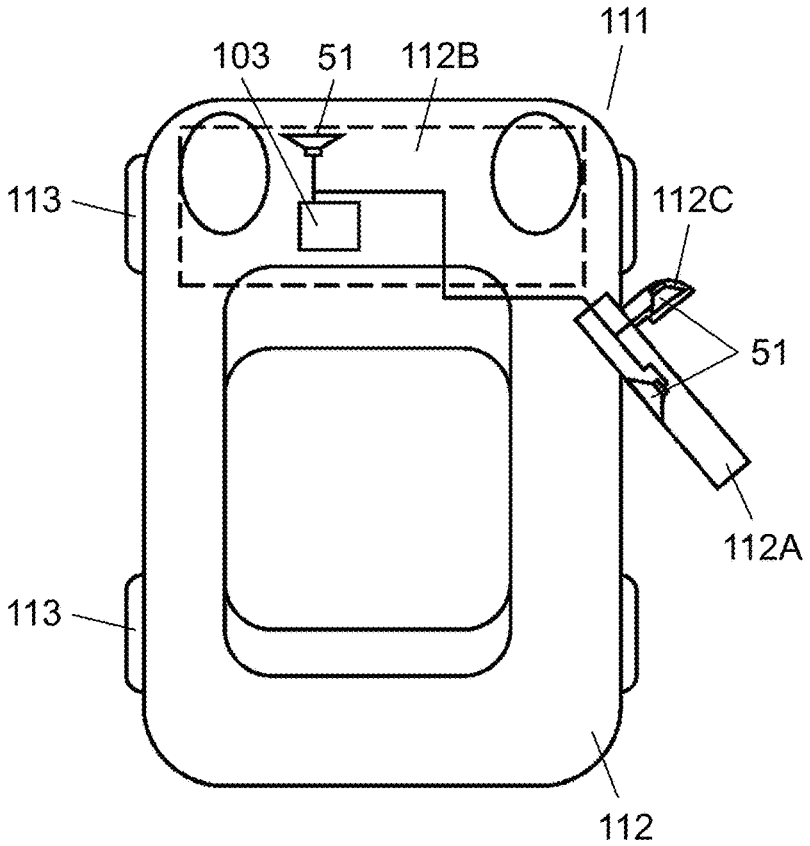
FIG. 9 is a conceptual diagram of a movable-body apparatus according to the embodiment of the present disclosure.

FIG. 9 is a conceptual diagram of movable-body apparatus 111 according to the present embodiment. Movable-body apparatus 111 is an automobile, for example, and includes body 112, driving unit 113, signal processor 103, and loudspeaker 51. Note that movable-body apparatus 111 is not limited to an automobile. Movable-body apparatus 111 may be, for example, a train, a motorcycle, a ship, or various vehicles for work. Driving unit 113 is mounted in body 112. Driving unit 113 may include, for example, an engine, a motor, and a tire. Body 112 can be moved by driving unit 113.

Signal processor 103 is accommodated in body 112. Loudspeaker 51 is fixed to body 112. In this case, for example, by using an adhesive or a screw, frame 52 illustrated in FIG. 1 is fixed to body 112. In the case where movable-body apparatus 111 is an automobile, body 112 may include door 112A, motor room (or engine room) 112B, and sideview mirror unit 112C. Loudspeaker(s) 51 may be accommodated in any of door 112A, motor room 112B, and sideview mirror unit 112C.

An output end of signal processor 103 is electrically connected to loudspeaker 51. In this case, the output end of signal processor 103 is electrically connected to a coil of voice coil body 54 illustrated in FIG. 1. Signal processor 103 may constitute a part of a car-navigation system or a part of a car audio. Furthermore, loudspeaker 51 may constitute a part of a car-navigation system or a part of a car audio. In the case where loudspeaker 51 is accommodated in, for example, door 112A, motor room 112B, or sideview mirror unit 112C, it is highly likely that loudspeaker 51 comes into contact with rain water. Therefore, coating layer 14 is preferably formed in the front face of diaphragm 11 as illustrated in FIG. 2A. With this structure, coating layer 14 prevents rain water from permeating through loudspeaker 51.

As described above, a vibration component for loudspeakers according to the present disclosure (hereinafter, referred to as the vibration component) includes a base layer, an intermediate layer, and a coating layer. The base layer has a front face and a rear face; has a first density; and is formed of a paper body containing a plurality of fibers. The intermediate layer has a first face joined to the front face of the base layer, and a second face on a reverse side of the intermediate layer from the first face; has a second density higher than the first density; and includes a plurality of cellulose fibers as a main component. The coating layer is provided on the second face of the intermediate layer, and includes an inorganic powder containing a plurality of inorganic fine particles. With this structure, the coating layer has a uniform thickness when the vibration component is coated, and thus the vibration component can have improved acoustic characteristics.

The coating layer may further include a coating material to embed the inorganic fine particles. In this case, the maximum thickness of the coating material may be smaller than the maximum particle diameter of the inorganic fine particles. This prevents that all the inorganic fine particles are coated with the coating material, thereby all the inorganic fine particles are not lost from sight, and thus, gloss is not lost. Furthermore, compared to a case in which the maximum thickness of the coating material is larger than the maximum particle diameter of the inorganic fine particles, the coating material is lighter in weight, and accordingly, favorable acoustic characteristics can be achieved.

Coating may be applied so as to partially embed at least some (one) of the inorganic fine particles in the intermediate layer. With this structure, stronger bonding between the coating layer and the intermediate layer is achieved, and thus, the coating layer is less likely to peel off from the intermediate layer, which results in an improvement in quality reliability.

The weight of the coating layer may be 1 wt % or more and 4 wt % or less with respect to the total weight of the vibration component. When the coating layer is too heavy in weight, acoustic characteristics deteriorate. When the coating layer is too light in weight, the grade of appearance is lowered. When the weight of the coating layer is 1 wt % or more and 4 wt % or less with respect to the total weight of the vibration component, the grade of appearance can be improved without deterioration of acoustic characteristics.

Each of the inorganic fine particles may have a particle diameter in a range from 10 μm to 60 μm, inclusive. When the particle diameter of each of the inorganic fine particles is larger than gaps formed in a surface of the intermediate layer, it is impossible that coating is applied so as to embed the inorganic fine particles in the intermediate layer. In contrast, when the particle diameter of each of the inorganic fine particles is too small, sufficient gloss cannot be acquired, thereby the grade of appearance cannot be improved. When the particle diameter of each of the inorganic fine particles is 10 μm or more and 60 μm or less, a vibration component being of high quality and having an excellent appearance can be provided.

The average diameter of the cellulose fibers may be smaller than the average diameter of the fibers constituting the base layer. This allows the intermediate layer to have a density higher than the density of the base layer, and thus, the intermediate layer can be provided so as to fill gaps in the base layer. Accordingly, when coating is applied to the vibration component, the coating layer has a uniform thickness. Thus, improved acoustic characteristics can be achieved.

The average fiber length of the cellulose fibers may be shorter than the average fiber length of the fibers of the base layer. This allows the intermediate layer to have a density higher than the density of the base layer, and thus, the intermediate layer can be provided so as to fill gaps in the base layer. Accordingly, when coating is applied to the vibration component, the coating layer has a uniform thickness. Thus, improved acoustic characteristics can be achieved.

The cellulose fibers may be nanofibers. In this case, the fibers are finer, and accordingly the intermediate layer has a higher density, thereby gaps in the base layer can be easily filled up. As a result, the coating layer has a uniform thickness, and thus improved acoustic characteristics can be achieved.

The cellulose fibers may be bamboo nanofibers. In this case, the use of bamboo as a raw material for the nanofibers allows the rigidity to be made higher and thereby allowing acoustic characteristics to be improved. Since bamboo is a plant, bamboo has an affinity for the base layer, whereby stronger bonding therebetween is provided.

The inorganic powder may contain at least one of mica and alumina. This allows the vibration component to have a higher rigidity.

The inorganic powder may further contain at least one of titanium oxide, iron oxide, and zirconia. This allows a desired color tone to be given to the vibration component, whereby the grade of appearance is improved.

The inorganic powder may further contain at least one of tin oxide, silicon dioxide, and glass. This allows a higher gloss to be given, thereby allowing the grade of appearance to be improved. Furthermore, stronger bonding between the intermediate layer and the coating layer is achieved.

In the case where the coating layer further includes a coating material to embed a plurality of inorganic fine particles, the coating material may include a thermosetting resin. Thus, the coating layer is less likely to peel off from the intermediate layer during heating or other processes following the application of coating.

In the case where the coating layer further includes a coating material to embed a plurality of inorganic fine particles, out of the fibers of the base layer, at least fibers exposed to the rear face of the base layer may be coated with the same material as the coating material. While gaps between the fibers of the base layer are maintained, the surfaces of some of the fibers are thus covered with a resin so that the fibers are bonded or coupled together, whereby, while an internal loss is maintained, rigidity can be enhanced.

A loudspeaker according to the present disclosure includes a frame, a magnetic circuit provided with a magnetic gap, a diaphragm, and a voice coil body. The magnetic circuit and the diaphragm are coupled to the frame. The voice coil body has a first end coupled to the diaphragm, and a second end inserted in the magnetic gap. At least one of the diaphragm and the voice coil body is formed of the above-described vibration component. In the case where the diaphragm is formed of the above-described vibration component, the loudspeaker has a wider reproduction frequency band, and also has a higher sound pressure level. In the case where the voice coil body is formed of the above-described vibration component, deterioration of acoustic characteristics due to an influence of humidity and the like can be prevented. With the effects of the intermediate layer, the surface can be coated with less roughness, and thus, even when coating is applied, acoustic characteristics can be maintained.

A movable-body apparatus according to the present disclosure includes a movable body, a driving unit, a signal processor, and a loudspeaker. The driving unit is mounted to the body and configured to move the body. The signal processor is mounted to the body. The diaphragm of the loudspeaker is formed of the above-described vibration component. The loudspeaker is accommodated in the body. This structure permits a person in a space inside the mobile body to enjoy high quality sounds emitted from the loudspeaker and enjoy a high quality appearance.

INDUSTRIAL APPLICABILITY

A diaphragm for loudspeakers according to the present disclosure has a high elasticity and a large internal loss, thereby being useful when used for, for example, loudspeakers to be mounted to an electronic device, a movable-body apparatus, or other devices.

REFERENCE MARKS IN THE DRAWINGS

11, 11A, 11B, 11C diaphragm
12 base layer
12F front face
12R rear face
13 intermediate layer
14 coating layer
14A first coating part
14B second coating part
22 natural fiber
22A wood pulp
23 cellulose fiber
23A cellulose nanofiber
23C bamboo nanofiber
24 inorganic powder
24P inorganic fine particle
25, 25A coating material
51 loudspeaker
52 frame
53 magnetic circuit
53A magnetic gap
54 voice coil body
55, 55B first end
56 second end
57 edge
58, 58A, 58B bobbin
101 electronic device
102 casing
103 signal processor
111 movable-body apparatus
112 body
112A door
112B motor room
112C sideview mirror unit
113 driving unit
131 first face
132 second face

What is claimed is:

1. A vibration component for loudspeakers, comprising:

a base layer having a front face and a rear face, the base layer having a first density and being formed of a paper body containing a plurality of fibers;

an intermediate layer:

having a first face joined to the front face of the base layer, and a second face on a reverse side of the intermediate layer from the first face, having a second density higher than the first density, and including a plurality of cellulose fibers as a main component; and a coating layer provided on the second face of the intermediate layer, the coating layer including an inorganic powder containing a plurality of inorganic fine particles, wherein the coating layer further includes a coating material embedding the inorganic fine particles, and the coating material has a maximum thickness smaller than a maximum particle diameter of the inorganic fine particles.

2. The vibration component for loudspeakers according to claim 1, wherein at least one of the inorganic fine particles is partially embedded in the intermediate layer.

3. The vibration component for loudspeakers according to claim 1, wherein a weight of the coating layer is 1 wt % or more and 4 wt % or less with respect to a total weight of the vibration component for loudspeakers.

4. The vibration component for loudspeakers according to claim 1, wherein each of the inorganic fine particles has a diameter of 10 μm or more and 60 μm or less.

5. The vibration component for loudspeakers according to claim 1, wherein the cellulose fibers has an average diameter smaller than an average diameter of the plurality of fibers of the base layer.

6. The vibration component for loudspeakers according to claim 1, wherein the cellulose fibers has an average fiber length shorter than an average fiber length of the plurality of fibers of the base layer.

7. The vibration component for loudspeakers according to claim 1, wherein each of the cellulose fibers is a nanofiber.

8. The vibration component for loudspeakers according to claim 1, wherein each of the cellulose fibers is a bamboo nanofiber.

9. The vibration component for loudspeakers according to claim 1, wherein the inorganic powder contains at least one of mica and alumina.

10. The vibration component for loudspeakers according to claim 9, wherein the inorganic powder further contains at least one of titanium oxide, iron oxide, and zirconia.

11. The vibration component for loudspeakers according to claim 10, wherein the inorganic powder further contains at least one of tin oxide, silicon dioxide, and glass.

12. The vibration component for loudspeakers according to claim 1, wherein the coating material contains a thermosetting-resin.

13. The vibration component for loudspeakers according to claim 1, wherein out of the plurality of fibers of the base layer, at least fibers exposed to the rear face are coated with a same material as the coating material.

14. A loudspeaker comprising:

a frame;

a magnetic circuit provided with a magnetic gap and coupled to the frame;

a diaphragm coupled to the frame; and a voice coil body:

including a first end coupled to the diaphragm, and a second end inserted in the magnetic gap, and formed of the vibration component for loudspeakers according to claim 1.

15. A loudspeaker comprising:

a frame;

a magnetic circuit provided with a magnetic gap and coupled to the frame;

a diaphragm coupled to the frame and formed of the vibration component for loudspeakers according to claim 1; and a voice coil body including a first end coupled to the diaphragm, and a second end inserted in the magnetic gap.

16. A movable-body apparatus comprising:

a movable body;

a driving unit mounted to the body and configured to move the body;

a signal processor mounted to the body; and the loudspeaker according to claim 15, the loudspeaker being accommodated in the body.

17. The vibration component for loudspeakers according to claim 1, wherein at least one of the inorganic fine particles is partially stuck in the intermediate layer.

18. The vibration component for loudspeakers according to claim 1, wherein at least one of the inorganic fine particles is partially exposed from the coating material.

19. A vibration component for loudspeakers, comprising:

a base layer having a front face and a rear face, the base layer having a first density and being formed of a paper body containing a plurality of fibers;

an intermediate layer:

having a first face joined to the front face of the base layer, and a second face on a reverse side of the intermediate layer from the first face, having a second density higher than the first density, and including a plurality of cellulose fibers as a main component; and a coating layer provided on the second face of the intermediate layer, the coating layer including an inorganic powder containing a plurality of inorganic fine particles, wherein, out of the fibers of the base layer, at least fibers exposed to the rear face of the base layer are coated with a same material as the coating layer.

* * * * *